United States Patent [19]

Tomura

[11] 4,202,641

[45] May 13, 1980

[54] MULTIPLE-POINT WRITING INSTRUMENT INCLUDING A MECHANICAL PENCIL UNIT

[75] Inventor: Yoshihiro Tomura, Omiya, Japan

[73] Assignee: Pilot Man-Nen-Hitsu Kabushiki Kaisha, Tokyo, Japan

[21] Appl. No.: 841,434

[22] Filed: Oct. 12, 1977

[30] Foreign Application Priority Data

Oct. 16, 1976 [JP] Japan ..... 51-139243[U]

[51] Int. Cl.[2] ..... B43K 24/10; B43K 24/18; B43K 27/02

[52] U.S. Cl. ..... 401/32; 401/33

[58] Field of Search ..... 401/16, 17, 19, 29–33, 401/116, 99

[56] References Cited

U.S. PATENT DOCUMENTS

| | | | |
|---|---|---|---|
| 2,264,463 | 12/1941 | Tomatsu | 401/30 |
| 2,434,234 | 1/1948 | Thatcher | 401/32 |
| 2,826,173 | 3/1958 | Gossweiler et al. | 401/33 |
| 3,023,735 | 3/1962 | Andonou | 401/33 |
| 3,266,465 | 8/1966 | Ganz | 401/33 |

FOREIGN PATENT DOCUMENTS

| | | | |
|---|---|---|---|
| 1237925 | 3/1967 | Fed. Rep. of Germany | 401/33 |
| 2218985 | 10/1973 | Fed. Rep. of Germany | 401/33 |
| 965615 | 9/1950 | France | 401/33 |
| 1131753 | 2/1957 | France | 401/33 |
| 273096 | 1/1951 | Switzerland | 401/17 |
| 252365 | 11/1926 | United Kingdom | 401/33 |

*Primary Examiner*—Edgar S. Burr
*Assistant Examiner*—Steven A. Bratlie
*Attorney, Agent, or Firm*—Wenderoth, Lind & Ponack

[57] ABSTRACT

A mechanical pencil unit of the pushbutton-action type and a ballpoint pen unit are housed in a common holder having top and bottom sections which are rotatable in oppposite directions relative to each other. Mounted within the holder and substantially secured to its bottom section only is a cradle which supports and constrains the two writing units for independent longitudinal motion with respect to the holder. The writing units are spring-biased into sliding engagement with an overhanging, downward-facing cam ledge on the inside surface of the holder top section, such that the writing units are selectively moved from a retracted to a writing position upon manual rotation of the holder top section in either direction relative to its bottom section. Upon movement of the mechanical pencil unit to the writing position, an offset pusher finger extending downwardly from a pushbutton on the holder is moved into alignment with the pencil unit for actuating and making the same ready for writing or marking.

4 Claims, 10 Drawing Figures

FIG. 5
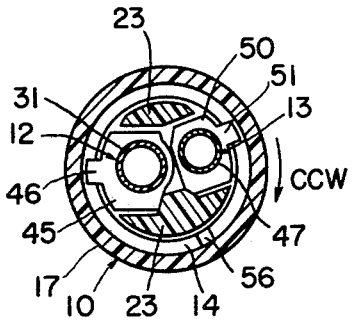
FIG. 7
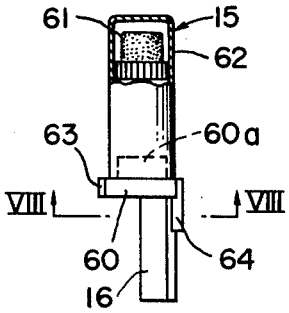
FIG. 6
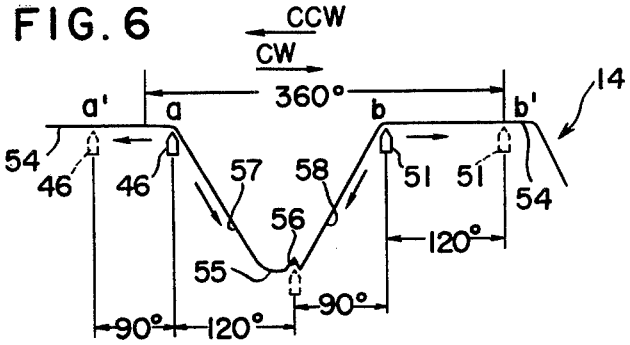
FIG. 9
FIG. 8
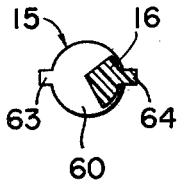
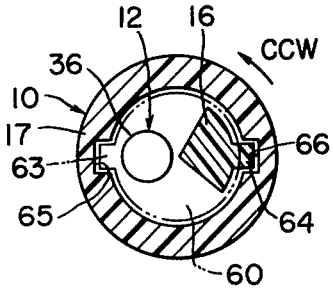
FIG. 10
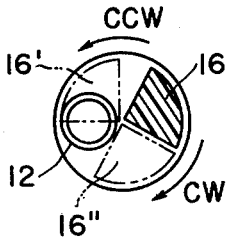

MULTIPLE-POINT WRITING INSTRUMENT INCLUDING A MECHANICAL PENCIL UNIT

BACKGROUND OF THE INVENTION

This invention relates to writing or marking instruments, and more specifically to a writing instrument which permits selective use of a plurality of writing units of different varieties. Still more specifically, the invention deals with such a multiple-point writing instrument comprising a mechanical pencil unit of the pushbutton-action type and at least one other writing unit of a different variety such as, for instance, a ballpoint pen unit.

A multiple-point writing instrument including a mechanical pencil unit, along with a ballpoint pen unit or the like, requires special consideration in the design of its mechanism for the selective feed-out or extension of the writing units to a writing position. This is because, while the ballpoint pen unit or the like is ready for writing or marking when it is fed out to the writing position, the mechanical pencil unit requires further actuation when it reaches the writing position for propelling a lead out of its writing tip. The selective feed-out mechanism must therefore be provided, and functionally associated, with means for propelling a lead out of the mechanical pencil unit when it is in its writing position.

Although a variety of writing unit feed-out mechanisms have been suggested and employed for multiple-point writing instruments of the type in question, they are almost inevitably complex in construction and difficult to manufacture or assemble for the above stated reason, with the resultant increase in the manufacturing costs of the writing instruments themselves. The advent of a truly simple writing unit feed-out mechanism has long been awaited in the stationery industry.

SUMMARY OF THE INVENTION

It is an object of this invention to provide a greatly simplified and inexpensive multiple-point writing instrument which permits selective use of a plurality of writing units including a mechanical pencil unit.

Another object of the invention is to provide a multiple-point writing instrument which is constituted by a minimum number of working parts to facilitate manufacture or assembly and which is extremely easy to operate.

A further object of the invention is to provide a multiple-point writing instrument which permits ready replacement or replenishment of the writing units.

Briefly described, the multiple-point writing instrument in accordance with this invention comprises a cylindrical holder having top and bottom sections which are rotatable around their axis relative to each other, the holder housing a mechanical pencil unit of the pushbutton-action type and at least one other writing unit of a different variety. These writing units are constrained to independent longitudinal motion between retracted and writing positions with respect to the holder by means of a writing unit cradle also mounted therein and substantially non-rotatably connected to its bottom section. The writing instrument further comprises feed-out cam means formed on the inside surface of the top section of the holder and relatively slidably engaged with the writing units therein, the feed-out cam means being such that the writing units are selectively moved from the retracted to the writing position upon rotation of the holder top section in either direction relative to the holder bottom section.

The mechanical pencil unit, however, requires further actuation in the writing position for projecting a lead out of its writing tip. To this end the invention contemplates the use of a pushbutton which is mounted on the holder and which has an offset pusher extending downwardly therefrom so as to be moved substantially into alignment with the mechanical pencil unit when the latter reaches the writing position. Thus, upon depression of the pushbutton following the movement of the mechanical pencil unit from the retracted to the writing position, the pencil unit is actuated by the offset pusher and is thus ready for writing or marking.

The above and other objects, features and advantages of this invention and the manner of attaining them will become more apparent, and the invention itself will best be understood, from the following description and claims taken in conjunction with the accompanying drawings showing a preferred embodiment of the invention.

BRIEF DESCRIPTION OF THE DRAWINGS

FIG. 5 is an enlarged cross-sectional view taken along the line V—V in FIG. 1;

FIG. 6 shows the writing unit feed-out cam of the writing instrument as developed in one plane for explaining the functions of the cam;

FIG. 7 is a side elevational view, with a portion broken away for clarity, of the pushbutton and the offset pusher finger of the writing instrument;

FIG. 8 is a cross-sectional view taken along the line VIII—VIII in FIG. 7;

FIG. 9 is a cross-sectional view taken along the line IX—IX in FIG. 1; and FIG. 10 is a schematic cross-sectional view for explaining the various angular positions of the offset pusher finger relative to the mechanical pencil unit during the operation of the writing instrument.

DETAILED DESCRIPTION

Figure 1:
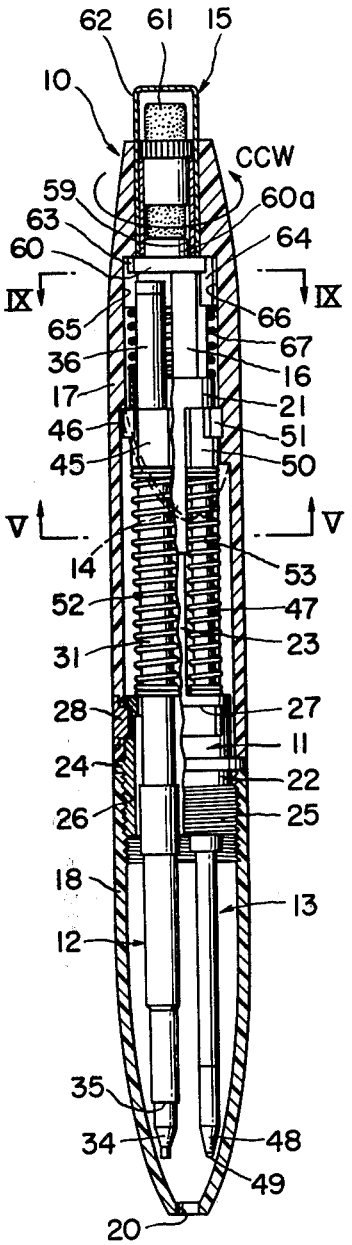
FIG. 1 is an axial sectional view, with portions broken away for clarity, of the multiple-point writing instrument according to this invention, the view showing the mechanical pencil unit and the ballpoint pen unit in the retracted positions.
Figure 2:
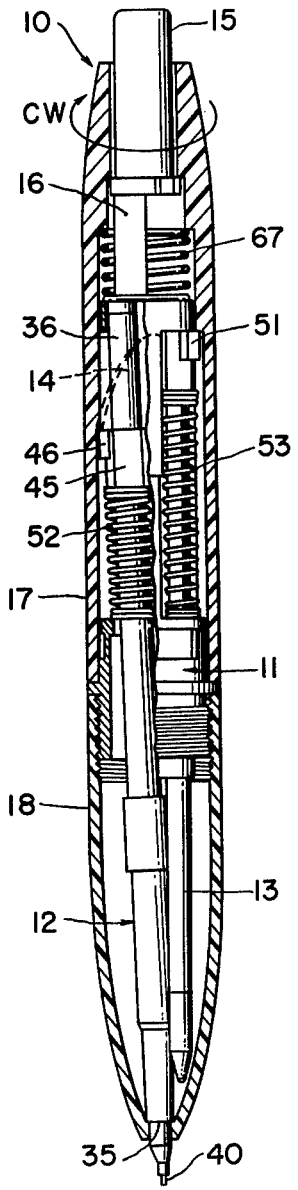
FIG. 2 is a view similar to FIG. 1 except that the mechanical pencil unit is shown in a writing position.

In the accompanying drawings, the multiple-point writing instrument in accordance with this invention is shown adapted, by way of example only, to permit selective use of a mechanical pencil unit and a ballpoint pen unit. With reference to FIGS. 1 and 2, the illustrated multiple- or dual-point writing instrument broadly comprises a cylindrical holder 10, a writing unit guide frame or cradle 11 mounted within the holder for supporting a mechanical pencil unit 12 of the pushbutton-action type (hereinafter referred to as the "pencil unit") and a ballpoint pen unit 13 (hereinafter referred to as the "pen unit") in side-by-side relationship and constraining these pencil and pen units to independent longitudinal motion between retracted and writing positions with respect to the holder, a writing unit feed-out cam 14 formed on the inside surface of the holder for selectively moving the pencil and pen units between the retracted and the writing positions, and a pushbutton 15 having an offset pusher finger 16 for actuating, and thus making ready for writing or marking, the pencil unit following the movement thereof from the retracted to the writing position.

Figure 3:
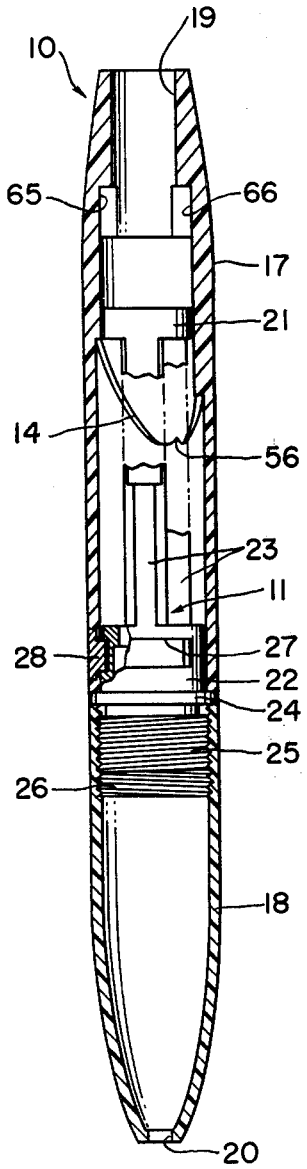
FIG. 3 is an axial sectional view of the holder of the writing instrument of FIGS. 1 and 2, together with the writing unit cradle mounted therein, the cradle being shown in elevation and partly broken away for clarity.

FIG. 3 best illustrates the configuration of the holder 10 and of the writing unit cradle 11 mounted therein. The holder 10 comprises a top section 17 of substantially cylindrical shape and a bottom section 18 of substantially bullet-like shape, which are oriented coaxially with each other. The holder top section 17 has a bore 19 formed axially through its top for loosely or slidably receiving the pushbutton 15, and the feed-out cam 14 in the form of an overhanging, downward-facing ledge is formed integrally on the inside surface of the holder top section, as will be later explained in detail. The holder bottom section 18 has a constricted mouth 20 at its bottom end to permit the tips of the pencil and pen units 12 and 13 to project outwardly therethrough as they are selectively fed out to the writing position, as will be seen from FIG. 2.

With further reference to FIG. 3, the writing unit cradle 11 comprises a cylindrical top portion 21 fitted in the holder top section 17, a cylindrical bottom portion 22 located at the junction of the holder top and bottom sections 17 and 18, and two opposed connector bars 23 extending longitudinally through the interior of the holder top section to integrally connect the top and bottom portions 21 and 22.

The bottom portion 22 of the writing unit cradle 11 has a flange 24 which is located intermediate its opposite ends and which is held between the holder top and bottom sections 17 and 18. Under the flange 24 the cradle bottom portion 22 is externally screw-threaded at 25 for threaded engagement with an internal screw thread 26 on the holder bottom section 18. Above the flange 24 the cradle bottom portion 22 has a guide groove 27 extending circumferentially thereof through a prescribed angle. A guide member 28 supported by the holder top section 17 projects inwardly thereof and is slidably engaged in the guide groove 27 in the cradle bottom portion 22.

It is thus seen that the writing unit cradle 11 performs the dual purposes of supporting the pencil and pen units 12 and 13 and of connecting the top and bottom sections 17 and 18 of the holder 10 so as to permit the holder top and bottom sections to be rotated in both directions relative to each other. It will also be evident that the guide groove 27 slidably receiving the guide member 28 is effective to set limits upon the angle of such bidirectional rotation of the holder top and bottom sections 17 and 18 relative to each other.

Figure 4:
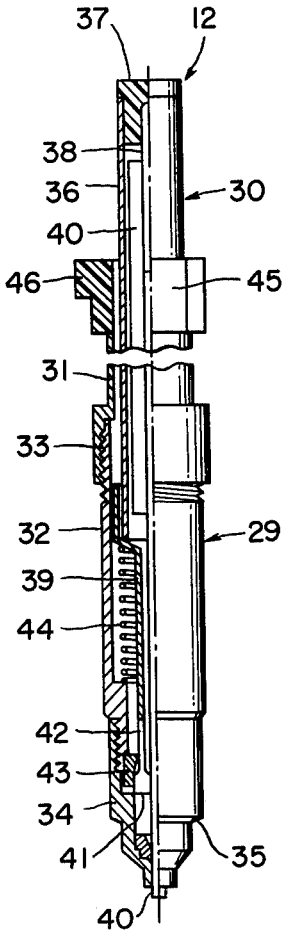
FIG. 4 is an enlarged, broken detail view, half in axial section and half in elevation, of the mechanical pencil unit seen in FIGS. 1 and 2.

Of the two writing units supported by and within the writing unit cradle 11 of the foregoing configuration, the mechanical pencil unit 12 of the pushbutton-action type is illustrated on an enlarged scale in FIG. 4. The pencil unit 12 broadly comprises an outer tube 29 and an inner tube 30, with the latter being nested telescopically in the former. The outer tube 29 comprises a top section 31 and a bottom section 32 which are screw-threadedly or detachably engaged with each other at 33. A tip member 34 further extends downwardly from the outer tube bottom section 32, and this tip member is shouldered at 35 for abutting engagement with the extreme front end edge of the holder 10 bounding the constricted mouth 20 when the pencil unit 12 is moved to the writing position, as illustrated in FIG. 2.

The inner tube 30 of the pencil unit 12 comprises an upper, "lead" storage section 36 having its top end closed by a cap 37 complete with a needle 38 for removal of broken pencil leads, and a lead guide section 39 of reduced diameter extending downwardly from the lead storage section in axial alignment and in open communication therewith. The lead storage section 36 accommodates a suitable supply of leads 40. It should be understood that the term "lead" is herein used generically, to mean a relatively slender rod of any suitable marking material.

The lead guide section 39 of the pencil unit inner tube 30 terminates at its bottom end in a thickened lip 41 and is further slitted longitudinally at 42 to provide jaws for releasably gripping one of the leads 40 extending axially therethrough. Fitted over the slitted lip 41 of the lead guide section 39 is a tightening ring or tube 43 which is engaged between the outer tube bottom section 32 and the tip member 34. A compression spring 44 is coiled around the lead guide section 39 and is adapted to bias the inner tube 30 upwardly with respect to the outer tube 29 and hence to normally hold the gripping jaws closed or urged against the lead 40 by the tightening ring 43.

Upon depression of the inner tube 30 against the bias of the compression spring 44, therefore, the gripping jaws or slitted lip 41 is thrust forwardly or downwardly past the tightening ring 43 and is thus opened to permit the lead 40 to be propelled out of the tip member 34. Such operating principles of the pencil unit 12 are well known in the art, and they form no part of this invention. It may be mentioned, however, that by unscrewing the bottom section 32 of the pencil unit outer tube 29 from its top section 31, the bottom section 32 together with the pencil unit inner tube 30 can be withdrawn from within the top section 31, thereby facilitating the replenishment of the lead storage section 36 with fresh leads.

The top section 31 of the pencil unit outer tube 29 has an enlargement 45 which is cross-sectionally shaped as shown in FIG. 5 in accordance with this invention, for purposes hereinafter set forth. The enlargement 45 has a cam follower lug 46 projecting laterally therefrom which is held in sliding engagement with the aforesaid writing unit feed-out cam 14 on the inner surface of the holder top section 17.

The pen unit 13 supported by and within the writing unit cradle 11 in side-by-side relationship to the pencil unit 12 is seen in FIGS. 1 and 2. The pen unit 13 includes a tubular reservoir 47 containing a viscous ink or marking fluid and terminating at its bottom end in a conical writing tip 48. At the point of this writing tip is a socket for housing a rolling ball 49 which transfers the viscous marking fluid from the reservoir 47 onto a writing surface in accordance with the prior art. The pen unit 13 also has an enlargement 50 of the cross-sectional shape shown in FIG. 5, and a cam follower lug 51 projects laterally therefrom for sliding engagement with the writing unit feed-out cam 14.

Mounted within the writing unit cradle 11 as shown in FIG. 1, the pencil unit 12 and the pen unit 13 of the foregoing constructions are biased upwardly with respect to the holder 10 by respective helical compression springs 52 and 53 in order to urge their cam follower lugs 46 and 51 into engagement with the overhanging feed-out cam 14 on the inside surface of the holder top section 17. The compression spring 52 is coiled around the outer tube top section 31 of the pencil unit 12 and extends between the enlargement 45 and the bottom portion 22 of the writing unit cradle 11. The other compression spring 53 is coiled around the marking fluid reservoir 47 of the pen unit 13 and extends between the enlargement 50 and the cradle bottom portion 22.

With particular reference to FIG. 5, the enlargements 45 and 50 of the pencil and pen units 12 and 13 are slidably supported between the opposed connector bars 23 of the writing unit cradle 11. At least the upper portions of these connector bars 23 are cross-sectionally shaped as shown in FIG. 5 in accordance with the cross-sectional shapes of the enlargements 45 and 50, in order to permit the sliding motion of these enlargements only in the longitudinal direction of the holder 10.

It is therefore apparent that the pencil and pen units 12 and 13 supported by the writing unit cradle 11 are thereby constrained to independent longitudinal motion between the retracted positions of FIG. 1 and the extended or writing position with respect to the holder 10. FIG. 2 shows the pencil unit in the writing position. It will be noted from FIG. 1 that the pencil unit 12 has a greater longitudinal dimension than the pen unit 13 and normally has the lead storage section 36 on the inner tube 30 extending upwardly through and projecting out of the top portion 21 of the writing unit cradle 11.

In FIG. 6 is best represented the contour of the writing unit feed-out cam 14 provided in the form of a continuous, overhanging or downward-facing ledge on the inside surface of the holder top section 17. The feed-out cam 14 comprises an upper portion 54 disposed in a plane at right angles to the axis of the holder 10, a lower portion 55 having a notch 56, and first and second sloping portions 57 and 58 extending between the upper and the lower portions 54 and 55.

Normally, that is, when the top section 17 of the holder 10 is in a preassigned angular position relative to the bottom section 18, the cam follower lugs 46 and 51 on the pencil and pen units 12 and 13 are held in positions a and b at the junctions of the upper portions 54 and the first and the second sloping portions 57 and 58 of the feed-out cam. When the holder top section 17 is manually rotated in a counterclockwise direction relative to the bottom section 18, as indicated by the arrow designated by CCW in FIGS. 1 and 6, the cam follower lug 46 on the pencil unit 12 slides down the first sloping portion 57 of the feed-out cam. The entire pencil unit 12 is thus fed downwardly from the retracted position of FIG. 1 to the advance position where the lug 46 contacts the lower portion 55 of the cam. Further rotation causes engagement of the lug 46 in notch 56 which places the pencil unit 12 in the advanced writing position of FIG. 2 against the bias of the compression spring 52 and is retained in the writing position as the cam follower lug 46 is releasably engaged in the notch 56 in the feed-out cam lower portion 55.

The pen unit 13 can likewise be fed downwardly from the retracted to the advanced writing position against the bias of the compression spring 53 by rotating the holder top section 17 in a clockwise direction CW relative to the bottom section 18 from the normal angular position of FIG. 1, because then the cam follower lug 51 on the pen unit slides down the second sloping portion 58 of the feed-out cam 14. The pen unit 13 will also be retained in the writing position as the cam follower lug 51 thereon is releasably engaged in the notch 56.

It will be noted from FIG. 6 that the lower portion 55 of the feed-out cam 14 extends a comparatively short distance in substantially parallel relationship to the upper portion 54, and that the notch 56 is located at that end of the feed-out cam lower portion which adjoins the second sloping portion 58. The holder top section 17 must therefore be rotated relative to the bottom section 18 in the counterclockwise direction for moving the pencil unit 12 from the retracted to the writing position through an angle greater than the angle through which the holder top section is rotated in the clockwise direction for moving the pen unit 13 from the retracted to the writing position. The reasons for this will be made apparent presently.

Referring again to FIG. 1, the pushbutton 15 is loosely or slidably received in the bore 19 in the holder top section 17 so as to partly project upwardly therefrom. The pushbutton 15 comprises an eraser holder 59 in the shape of a hollow cylinder, a disc 60 closing the bottom of the eraser holder 59 by means of a projection **60*a* fitted therein and serving also to limit the motion of the pushbutton in the upward direction relative to the holder top section 17, an eraser unit 61 inserted into and supported by the eraser holder, and a cap 62** fitted over the eraser holder so as to enclose the eraser unit.

As will be seen also from FIGS. 7 and 8, the bottom disc 60 of the pushbutton 15 has two guide lugs 63 and 64 in diametrically opposite positions thereon and projecting laterally therefrom. Of these, the guide lug 64 extends downwardly from the disc 60, and both guide lugs 63 and 64 are slidably engaged in respective guide grooves 65 and 66 (FIGS. 3 and 9) that are formed longitudinally in the inside surface of the holder top section 17. The pushbutton 15 is thus constrained to movement only in the axial direction of the holder 10 and is rotatable simultaneously with the top section 17 relative to the bottom section 18.

A helical compression spring 67 is installed within the holder top section 17 and extends between the top portion 21 of the writing unit cradle 11 and the guide lug 64 on the pushbutton bottom disc 60. The compression spring 67 thus biases the pushbutton 15 upwardly with respect to the holder 10 and normally holds the pushbutton in the illustrated relative position, with the cap 62 partly projecting out of the holder bore 19.

Connected eccentrically to and extending downwardly from the pushbutton bottom disc 60, the offset pusher finger 16 is intended to actuate the pencil unit 12 of the pushbutton-action type after the same is moved from the retracted to the writing position by the counterclockwise rotation of the holder top section 17 relative to the bottom section 18. Normally, or when both pencil and pen units 12 and 13 are in the retracted positions as shown in FIG. 1, the offset pusher finger 16 is disposed in side-by-side or parallel relationship to the lead storage section 36 of the pencil unit inner tube 30 and substantially in alignment with the pen unit. Upon movement of the pencil unit 12 to the writing position as shown in FIG. 2, the offset pusher finger 16 is moved substantially into alignment with the pencil unit for actuating same.

As best shown in FIG. 9, the offset pusher finger 16 has a sector-shaped cross-section having an angle of 90 degrees. Further, normally, the offset pusher finger 16 is located slightly displaced in the counterclockwise direction CCW from the position diametrically opposite to the pencil unit 12.

The offset pusher finger 16 can therefore be carried to an angular position 16' (FIG. 10) where the pusher finger is substantially in alignment with the pencil unit 12, if the holder top section 17 is rotated relative to its bottom section 18 in the counterclockwise direction CCW from its normal angular position through an angle of 120 degrees. Thus, as specifically illustrated in FIG. 6, the cam follower lug 46 on the pencil unit 12 is normally angularly spaced 120 degrees in the counterclockwise direction CCW from the notch 56 in the feed-out cam 14, in order that the offset pusher finger 16 will be carried exactly to the position 16' when the pencil unit is moved from the retracted to the writing position.

It will also be noted from FIG. 6 that the cam follower lug 51 on the pen unit 13 is normally angularly spaced 90 degrees in the clockwise direction CW from the notch 56 in the feed-out cam 14. Thus, when the pen unit 13 is moved from the retracted to the writing position by the 90-degree clockwise rotation of the holder top section 17 relative to the bottom section 18, the offset pusher finger 16 is carried to an angular position designated at 16" in FIG. 10 and is thus prevented from colliding with the pencil unit 12.

Although the operation of the multiple-point writing instrument in accordance with the invention is believed clearly apparent from the foregoing, the following brief summary of such operation will now be given. For moving the pencil unit 12 of the writing instrument, which is in the normal position represented in FIG. 1, from the retracted to the writing position, the holder top section 17 is manually rotated in the counterclockwise direction CCW relative to the bottom section 18, thereby causing the cam follower lug 46 on the pencil unit to slide down the first sloping portion 57 of the feed-out cam 14.

The pencil unit 12 is thus forced downwardly against the bias of the compression spring 52 and substantially reaches the advanced position when the cam follower lug 46 thereon reaches the end of the first sloping portion 57 of the feed-out cam 14. Concurrently, the offset pusher finger 16 is carried very close to the lead storage section 36 of the pencil unit inner tube 30.

Upon continued counterclockwise rotation of the holder top section 17, the cam follower lug 46 on the pencil unit 12 slides along the lower portion 55 of the feed-out cam 14 with the pencil unit 12 in the advanced position until the lug becomes engaged in the notch 56. The pencil unit 12 remains substantially stationary while the cam follower lug 46 is sliding along the feed-out cam lower portion 55, but the offset pusher finger 16 continues travelling toward the position 16' in FIG. 10. The offset pusher finger 16 reaches this position 16' at exactly the time of the cam follower lug 46 engages in the notch 56, and the pencil unit 12 is then locked in the writing position, with the tip member shoulder 35 in abutting engagement with the edge of the holder 10 around the constricted mouth 20.

As will be readily understood from a consideration of FIG. 6, the cam follower lug 51 on the pen unit 13 slides along the feed-out cam upper portion 54 from the normal position b to a position b' through an angle of 120 degrees during the travel of the pencil unit 12 from the retracted to the writing position. As a consequence, the pen unit 13 is maintained in the retracted position as shown in FIG. 2.

The pushbutton 15 on the holder 10 is then depressed against the bias of the compression spring 67. The offset pusher finger 16 will then force the inner tube 30 of the pencil unit 12 downwardly into the outer tube 29 against the bias of the compression spring 44, with the result that the lead 40 is propelled out of the tip member 34 by the procedure described already. The pencil unit 12 is thus made ready for writing or marking.

The pencil unit 12 can be readily retracted into the holder 10 by rotating the top section 17 relative to the bottom section 18 in the clockwise direction CW, as indicated by the arrow in FIG. 2, through an angle of 120 degrees. Disengaged from the notch 56, the cam follower lug 46 on the pencol unit 12 will then slide up the first sloping portion 57 of the feed-out cam 14 under the bias of the compression spring 52, back to the normal position a in FIG. 6. The cam follower lug 51 on the pen unit 13 simultaneously slides along the feed-out cam upper portion 54 from the position b' back to the normal position b, so that the pen unit is still maintained in the retracted position.

For moving the pen unit 13 from the retracted to the writing position, the holder top section 17 is rotated in the clockwise direction CW through an angle of 90 degrees from the normal angular position relative to the holder bottom section 18. The cam follower lug 51 on the pen unit 13 will slide down the second sloping portion 58 of the feed-out cam 14. The pen unit 13 is thus forced downwardly against the bias of the compression spring 53, until the pen unit becomes locked in the writing position upon engagement of the cam follower lug 51 in the notch 56.

The cam follower lug 46 on the pencil unit 12 slides along the feed-out cam upper portion 54 from the normal position a to a position a' through an angle of 90 degrees during the travel of the pen unit 13 from the retracted to the writing position, so that the pencil unit is maintained in the retracted position. Further, as will be seen from FIG. 10, the offset pusher finger 16 travels to the position 16" angularly spaced 90 degrees from the normal position, without colliding with the pencil unit 12. It will be apparent that the pen unit 13 can be retracted by rotating the holder top section 17 in the counterclockwise direction CCW relative to the bottom section 18.

Thus, in accordance with this invention, the pencil unit 12 and the pen unit 13 can be use merely by rotating the holder top section 17 in either direction relative to the bottom section 18. Another pronounced feature of this invention is that the offset pusher finger 16 is normally disposed in parallel or side-by-side relationship to the upper end portion of the pencil unit 12, resulting in substantial simplification of the mechanism for the selective extension and retraction of the writing units. This arrangement also permits the total axial dimension of the writing instrument to be determined conveniently. It should also be appreciated that the invention is well calculated to expedite the replacement of the writing units and, in particular, the replenishment of the leads of the pencil unit 12.

What is claimed is:

1. A multiple-point writing instrument, comprising in combination:

a cylindrical holder having top and bottom sections in axial alignment which are rotatable around the axis thereof relative to each other;

two writing units provided in side-by-side positions in said holder, one of said writing units being a mechanical pencil unit having an outer tube, a lead gripping jaw means in said outer tube, an inner tube fixed to said jaw means and extending rearwardly from said outer tube toward said top section, and a tightening ring fixed within said outer tube for normally tightening said jaw means to cause it to grip a lead and for releasing said jaw means to enable feeding out of the lead only when said inner tube and said jaw means are pushed relative to said tightening ring forward toward the writing end of said pencil unit;

a cradle mounted within said holder and connected to said bottom section, said cradle having means rotatably supporting said top section relative to said cradle and said bottom section for said relative rotation, said cradle supporting said mechanical pencil unit and the other writing unit in the side-by-side positions and constraining the units to independent longitudinal motions between retracted positions in which the writing ends of the units are within said holder and advanced writing positions in which the writing ends of the units project out of the lower end of said bottom section of said holder;

resilient means engaging said writing units and urging them toward the retracted positions;

a feed-out cam in the form of an overhanging ledge on the inside suface of said top section of said holder and slidably engaged with the two writing units for selectively moving the respective units from the retracted to an advanced position and then to an advanced writing position upon rotation of said top section in one or the other direction relative to said bottom section, said cam having a lower ledge portion with a notch therein for releasably locking a selected one of two writing units when it is in the advanced writing position, first and second sloping ledge portions on opposite sides of the lower ledge portion, and an upper ledge portion extending circumferentially around the inside of said holder in a plane at right angles to the axis of said holder for engagement by the two writing units when they are in the retracted position, said first and second sloping ledge portions being associated with the mechanical pencil unit and the other writing unit, respectively, said lower ledge portion extending circumferentially a relatively short distance substantially parallel with the upper ledge portion for engaging the writing units for placing them in the advanced position, said notch being disposed at a position circumferentially offset from the center of the lower ledge portion toward the second sloping ledge portion, whereby said top section must be rotated a greater angular distance to move the mechanical pencil unit from the advanced position to the locked writing position than to move the other writing unit from the advanced position to the locked writing position;

a pushbutton mounted in said top section of said holder normally projecting rearwardly therefrom and for relative movement only in the axial direction of the holder; and an offset pusher extending from the pushbutton toward said writing units normally disposed in side-by-side relationship with the upper end portion of said mechanical pencil unit and movable into substantial axial alignment with said inner tube of said mechanical pencil unit when said mechanical pencil unit is moved from the retracted to the locked writing position by the rotation of said top section of said holder relative to the bottom section, whereby said mechanical pencil unit is moved to said advance position by engagement of said first sloping ledge portion prior to the time said offset pusher comes into alignment with said mechanical pencil unit so said offset pusher does not collide with said mechanical pencil unit, and upon depression of said pushbutton following the movement of said mechanical pencil unit from the advanced position to the locked writing position, said inner tube of said mechanical pencil unit is pushed by said offset pusher and is thus made ready for writing or marking.

2. A multiple-point writing instrument as claimed in claim 1, wherein said pushbutton means is an enclosure and a cap closing said enclosure.

3. A multiple-point writing instrument as claimed in claim 1, wherein said offset pusher has a sector-shaped cross-section having an angle of about 90 degrees.

4. A multiple-point writing instrument as claimed in claim 1, further comprising means for mounting said top section of said holder on said bottom section for rotation relative to said bottom section through an angle of about 120 degrees in the one direction for moving said mechanical pencil unit from the retracted to the writing position and through an angle of about 90 degrees in the other direction for moving the other writing unit from the retracted to the writing position.

* * * * *